US008557507B2

(12) United States Patent
Jang et al.

(10) Patent No.: US 8,557,507 B2
(45) **Date of Patent: *Oct. 15, 2013**

(54) FABRICATION OF NANO-TWINNED NANOPILLARS

(75) Inventors: Dongchan Jang, Pasadena, CA (US); Julia R. Greer, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/291,002

(22) Filed: Nov. 7, 2011

(65) Prior Publication Data

US 2012/0135260 A1 May 31, 2012

Related U.S. Application Data

(60) Provisional application No. 61/410,798, filed on Nov. 5, 2010.

(51) Int. Cl.
*G03F 7/26* (2006.01)

(52) U.S. Cl.
USPC ..... 430/315; 430/320

(58) Field of Classification Search
USPC ..... 430/320, 324, 315, 314, 319, 329
See application file for complete search history.

(56) References Cited

U.S. PATENT DOCUMENTS 8,299,341 B2 * 10/2012 Greer et al. ..... 257/E51.043

* cited by examiner

*Primary Examiner* — Kathleen Duda
*Assistant Examiner* — Caleen Sullivan
(74) *Attorney, Agent, or Firm* — Joseph R. Baker, Jr.; Gavrilovich, Dodd & Lindsey LLP

(57) ABSTRACT

Nanopillars with nanoscale diameters are provided where the nanopillar has uniformly aligned nano-twins either perpendicular or inclined by 1-90° to the pillar-axis with no grain-boundaries or any other features.

8 Claims, 6 Drawing Sheets

FIGURE 1B-C

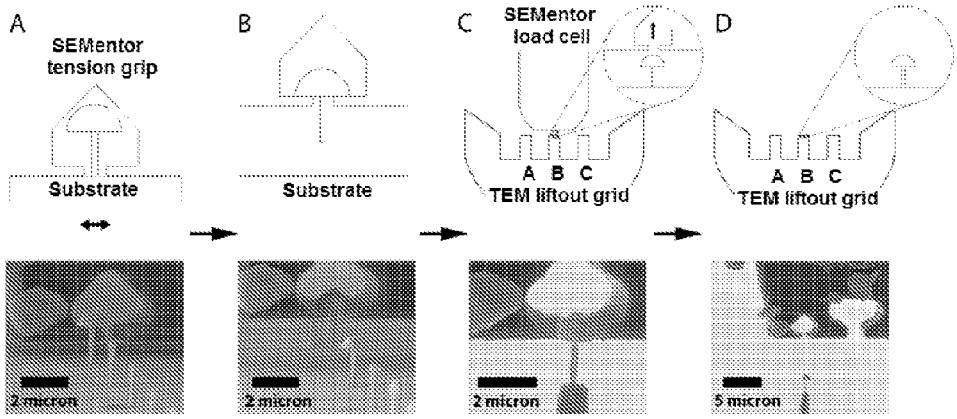
FIGURE 3A-D
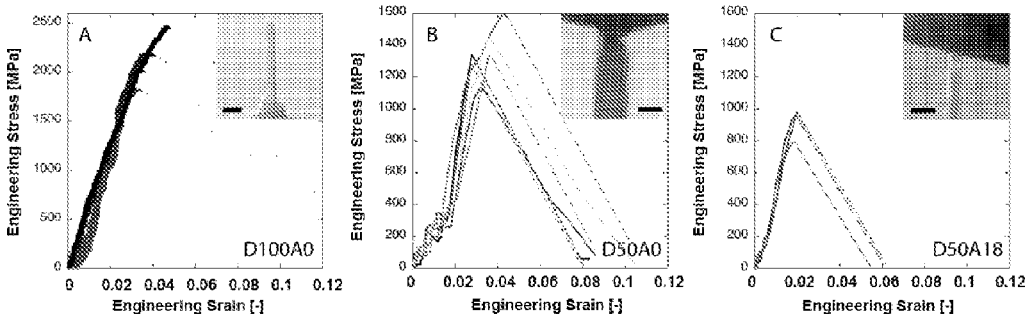
FIGURE 4A-C

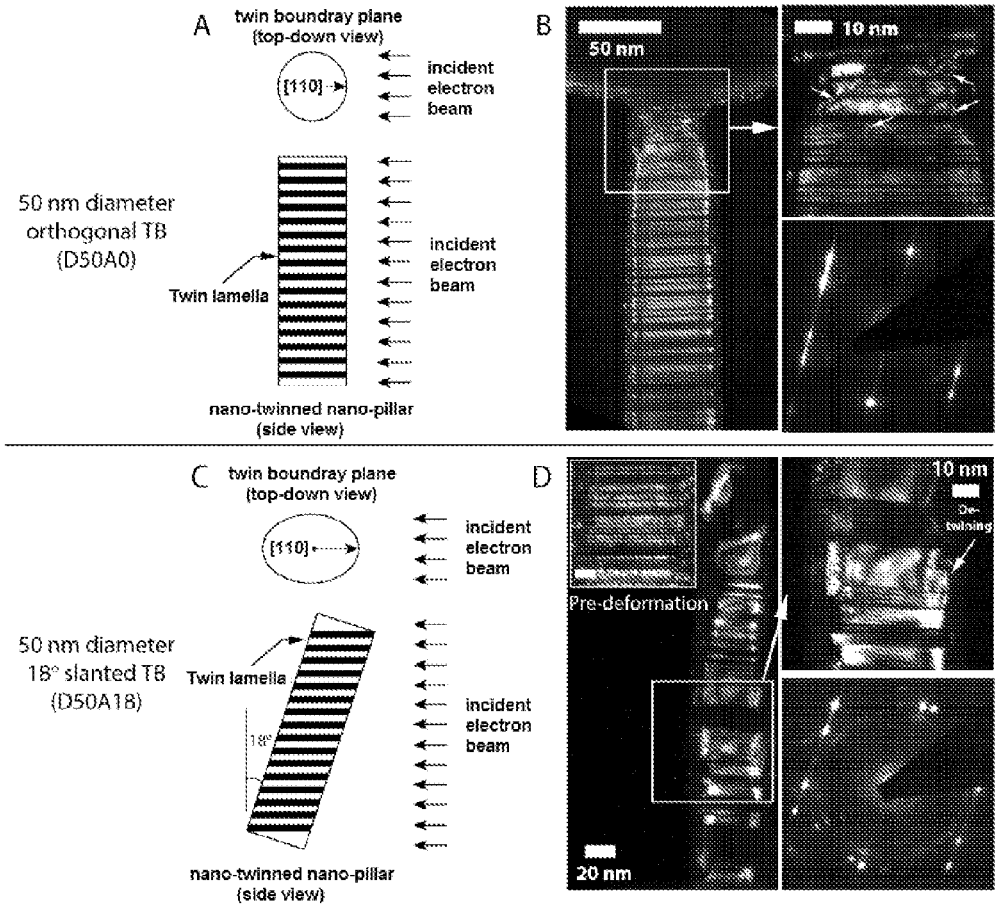
FIGURE 5A-D

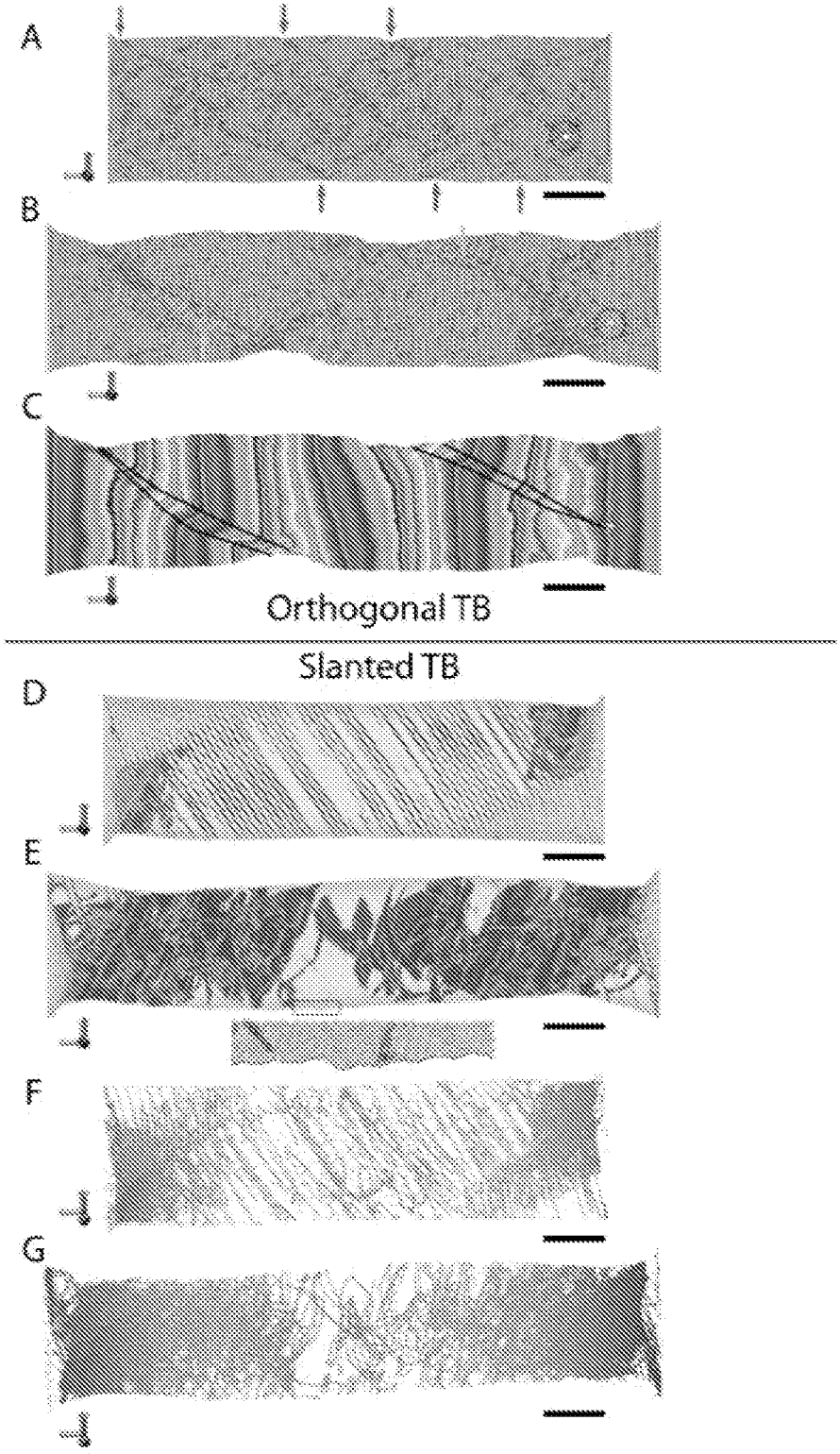
FIGURE 6A-G

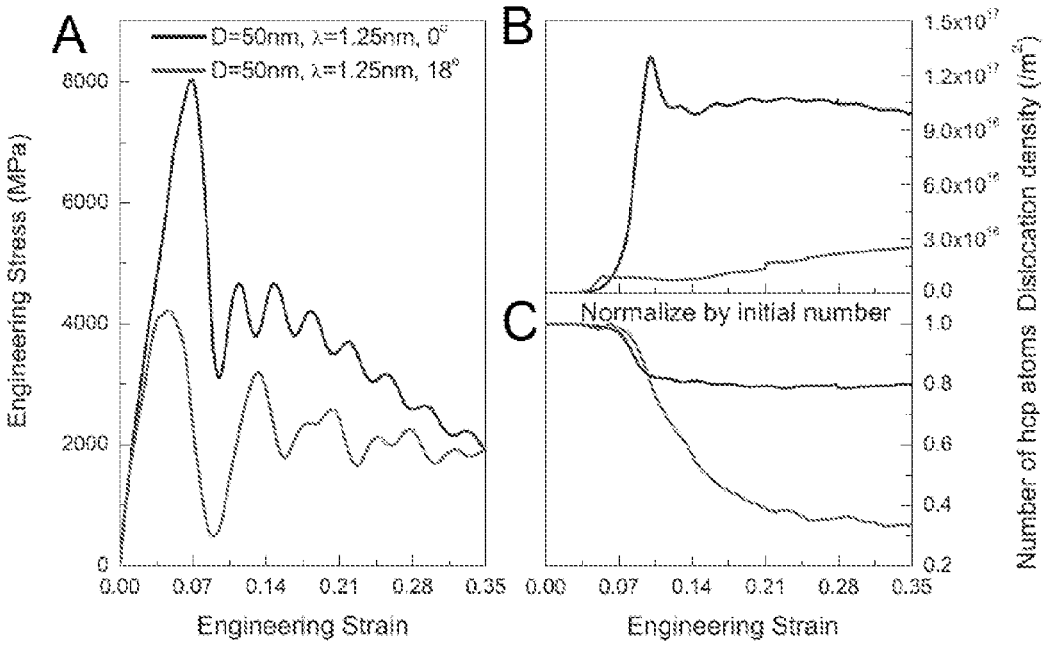
FIGURE 7A-C

FABRICATION OF NANO-TWINNED NANOPILLARS

CROSS REFERENCE TO RELATED APPLICATIONS

This application claims priority to U.S. Provisional Application Ser. No. 61/410,798, filed Nov. 5, 2010, the disclosure of which is incorporated herein by reference.

STATEMENT REGARDING FEDERALLY SPONSORED RESEARCH

This invention was funded in part by Grant No. DMR-0520565 awarded by the National Science Foundation. The Government has certain rights in the invention.

TECHNICAL FIELD

This invention relates to compositions and methods for generating nanostructures.

BACKGROUND

There is an increasing demand for methods for generating nanostructures for use in numerous electrical, optical, biological, mechanical and other technological devices. Such devices include, for example, solar cells, photo-detectors, micro-electro-mechanical system (MEMS), photonic crystals, memory devices, nano-filtration, fuel cells, and artificial kidneys. Conventional photolithography techniques cannot satisfy the small dimension requirements in many of these applications, due to the light source's wavelength limit.

SUMMARY

The disclosure provides a nano-twinned nanostructure array comprising a plurality nanostructures each nanostructure comprising uniformly aligned nano-twins either perpendicular or inclined from about 1-90° (90° being in-line with the pillar-axis) to the pillar-axis with no grain-boundaries or The disclosure also provides a nano-twinned nanostructure array, made by a process comprising (a) coating a substrate with a conductive layer; (b) coating the conductive layer with a resist polymer; (c) using a lithography technique (e.g., electron beam lithography, photolithography), shadow masking and the like, to pattern a template into the resist polymer; (d) electrodepositing a metal into the template, wherein the template comprises the template-cathode and wherein the process further comprise a non-patterned cathode wherein the total surface area of the template-cathode and non-patterned cathode is substantially equal to the surface area of the anode; and (e) optionally removing the resist. In one embodiment, the substrate comprises a material selected from the group consisting of silicon dioxide, fused-silica, quartz, silicon, organic polymers, siloxane polymers, borosilicate glass, fluorocarbon polymers, metal, hardened sapphire, and a ceramic. In a specific embodiment, the substrate is silicon. In another embodiment, the conductive layer comprises a conductive metal. In yet another embodiment, the resist layer is a photosensitive resist. In yet another embodiment, the resist polymer comprises polymethylmethacrylate. In one embodiment, the electrodepositing is by potentiostatic, galvanostatic or by alternating current/voltage techniques. In another embodiment, the metal is selected from the group consisting of gold, silver, rhodium, copper, chrome, nickel, brass, iridium, and alloys of any of the foregoing. In yet another embodiment, the method further comprises coating with a metal oxide or nitride.

The disclosure also provides a method of making a nano-twinned nanopillar composition comprising: (a) coating a substrate with a conductive layer; (b) coating the conductive layer with a resist polymer; (c) using an electron beam lithography technique to pattern a template into the resist polymer; (d) electrodepositing a metal into the template, wherein the template comprises the template-cathode and wherein the process further comprise a non-patterned cathode wherein the total surface area of the template-cathode and non-patterned cathode is substantially equal to the surface area of the anode; and (e) removing the resist. In one embodiment, the substrate comprises a material selected from the group consisting of silicon dioxide, fused-silica, quartz, silicon, organic polymers, siloxane polymers, borosilicate glass, fluorocarbon polymers, metal, hardened sapphire, and a ceramic. In a specific embodiment, the substrate is silicon. In another embodiment, the conductive layer comprises a conductive metal. In yet another embodiment, the resist polymer comprises polymethylmethacrylate. In one embodiment, the electrodepositing is by potentiostatic, galvanostatic or by alternating current/voltage techniques. In another embodiment, the metal is selected from the group consisting of gold, silver, rhodium, copper, chrome, nickel, brass, iridium, and alloys of any of the foregoing. In yet another embodiment, the method further comprises coating with a metal oxide or nitride.

The disclosure also provides an electrical, optical or MEMS device comprising a nano-twinned nanostructure array comprising a plurality nanostructures each nanostructure comprising uniformly aligned nano-twins either perpendicular or inclined from about 1-90° to the pillar-axis with no grain-boundaries.

The disclosure demonstrates successful fabrication of free-standing individual nano-twinned Cu nano-pillars with no grain boundaries. The orientation of nano-twin lamellae is either perpendicular to the pillar axis or slanted by about 1-90°. The twin-boundaries (TBs) are highly coherent, spaced at 1.2 or 4.3 nm and the specimens are free of initial dislocations. The 50 nm diameter nano-twinned nano-pillars exhibit non-trivial plasticity, with the tensile strength of orthogonal-TBs samples of 1.35 GPa, which is ~40% higher than that of 50 nm-diameter samples with slanted TBs. The genesis of this strength differential lies in the distinction in their deformation mechanisms: necking and shear localization caused by TB-dislocation interaction dominates the plastic deformation in orthogonal-TB samples while partial dislocation glide along inclined TBs followed by de-twinning controls deformation in slanted-TB samples. Despite these differences, deformation in both types of structures is accommodated by dislocation nucleation at the TB-free surfaces interfaces, with their subsequent activity dictated by the shear force acting along the twin boundaries. Further nano-scale plasticity of 100 nm-diameter pillars with orthogonal TBs fail in a brittle fashion upon tension, attaining ultimate tensile strengths of 2.1 GPa, which represents ~40% of the theoretical strength and is one of the highest strengths ever reported for Cu.

BRIEF DESCRIPTION OF THE DRAWINGS

FIG. 1A-C shows representations of the fabrication of nanotwinned pillars of the disclosure. (A) Schematic showing nano-twinned nano-pillar fabrication steps. (B) Schematic representation of the electroplating apparatus. (C) The waveform of the pulsed electro-plating current.

FIG. 3A-D is an illustration showing the plucking process for TEM analysis. (A) A nano-pillar is placed within the SEMentor tension grip, and detached from the substrate by gently shaking the sample stage. (B) The detached nano-pillar is lifted up by the SEMentor tension grip. (C,D) The lifted nano-pillar is transferred on top of a post in the TEM lift-out grid.

FIG. 4A-C show stress-strain curves. (A,B,C) Engineering stress-strain curves of D100A0, D50A0, and D50A18, respectively. The insets are post-deformation SEM (A,C) and bright-field TEM (B) images. Scale bars of each inset indicate 200 nm, 100 nm and 50 nm, respectively.

FIG. 5A-D shows illustration and images of pillars during tension experiments. (A,C) Schematic illustrations describing orientation of [110] zone axis lying on the TB plane aligned with incident electron beams in the TEM. (B) TEM dark-field images (left and top-right) and electron difraction pattern (bottom-right) of a deformed D50A0 pillar showing neck formation and evidences of inter-TB dislocation activities. (D) TEM dark-eld images (left and top-right) and electron difraction pattern (bottom-right) of a deformed D50A18 pillar showing de-twinning. The inset in the left image shows typical undeformed pillar (scale bar is 10 nm).

FIG. 6A-G shows deformation characteristics of the simulated samples with orthogonal (A-C) and slanted (D-G) TBs. (A) Atomic structures along the middle longitudinal section of the deformed sample at strain of $\epsilon$=10.52%. (B,C) Atomic structures along the middle longitudinal section of the deformed sample at strain of $\epsilon$=34.98%. Note that the microstructures pointed by the orange arrows in (B) are in well-developed shear bands where the original TBs have been completely destroyed. The regions surrounded by the black lines in (C) represent shear bands where the lattice structures are severely distorted. (D,E) Sectional view at the strain of $\epsilon$=10.52% (D) and $\epsilon$=34.98% (E). The region marked by the black rectangle is magnified on the bottom. This inset shows two dislocations being nucleated from surface steps due to the early de-twinning. (F,G) Dislocation structures at the strain of $\epsilon$=10.52% and $\epsilon$=34.98%, respectively. Compared to (G), dislocation structure in (F) is more ordered.

FIG. 7A-C shows MD simulations of nanotwinned Cu pillars under uniaxial tension. (A) Stress-strain curves. (B) Evolution of dislocation density with the applied strain. (C) Variation of the normalized number of hcp atoms with the applied strain.

DETAILED DESCRIPTION

Figure 1A:
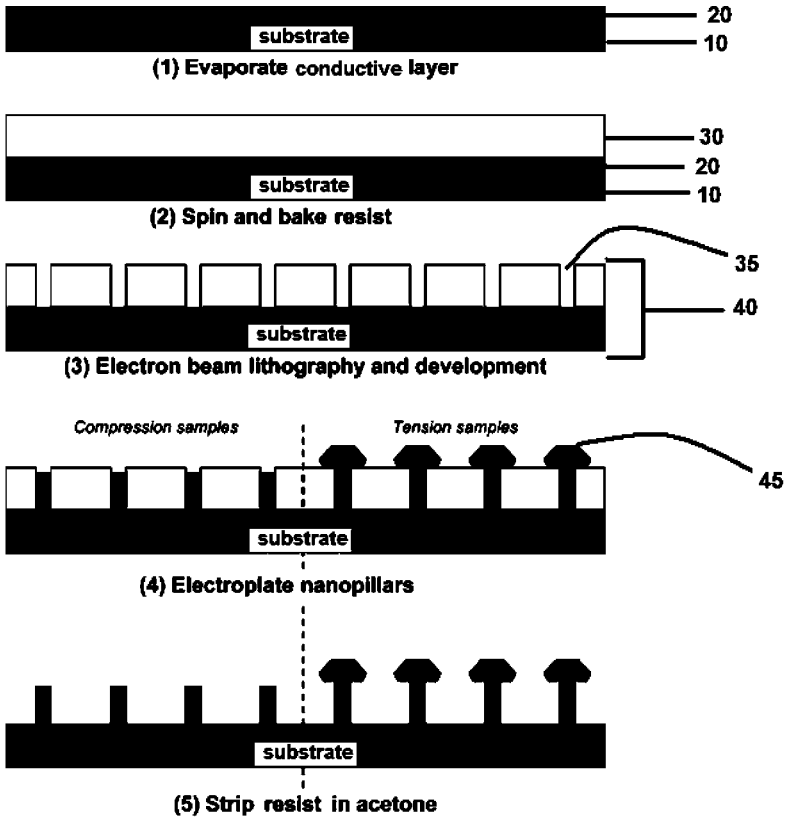

As used herein and in the appended claims, the singular forms "a," "and," and "the" include plural referents unless the context clearly dictates otherwise. Thus, for example, reference to "a pillar" includes a plurality of such pillars and reference to "the nanostructure" includes reference to one or more nanostructures known to those skilled in the art, and so forth.

Also, the use of "or" means "and/or" unless stated otherwise. Similarly, "comprise," "comprises," "comprising" "include," "includes," and "including" are interchangeable and not intended to be limiting.

It is to be further understood that where descriptions of various embodiments use the term "comprising," those skilled in the art would understand that in some specific instances, an embodiment can be alternatively described using language "consisting essentially of" or "consisting of:"

By "about" is meant a quantity, level, value, number, frequency, percentage, dimension, size, amount, weight or length that varies by as much as 30, 25, 20, 25, 10, 9, 8, 7, 6, 5, 4, 3, 2 or 1% to a reference quantity, level, value, number, frequency, percentage, dimension, size, amount, weight or length.

With respect to ranges of values, the invention encompasses each intervening value between the upper and lower limits of the range to at least a tenth of the lower limit's unit, unless the context clearly indicates otherwise. Further, the invention encompasses any other stated intervening values. Moreover, the invention also encompasses ranges excluding either or both of the upper and lower limits of the range, unless specifically excluded from the stated range.

Unless defined otherwise, all technical and scientific terms used herein have the same meaning as commonly understood to one of ordinary skill in the art to which this disclosure belongs. Although methods and materials similar or equivalent to those described herein can be used in the practice of the disclosed methods and compositions, the exemplary methods, devices and materials are described herein.

The publications discussed above and throughout the text are provided solely for their disclosure prior to the filing date of the present application. Nothing herein is to be construed as an admission that the inventors are not entitled to antedate such disclosure by virtue of prior disclosure.

There has been an interest in size-dependent mechanical properties of micro- and nano-structures due to the advancements in the instrumental resolution and in computational capabilities. In the case of single crystalline metals, the size effects manifest themselves as a pronounced increase in compressive strength when the external dimensions are reduced to the micrometer and submicrometer scale.

Establishing processing routes to design materials with desired properties through controlling their microstructure is one of the most fundamental principles in materials science and engineering. Traditionally, this has been achieved by first understanding the physical mechanisms responsible for the desired properties and subsequently developing the processing technique to result in a microstructure, which facilitates these mechanisms. For example, in crystalline materials, where plasticity is carried by the motion of dislocations, creating microstructures which impede dislocation glide significantly increases their strength. Such microstructures may include grain boundaries, precipitates, dislocation forests, or solute atoms. In some cases, this strategy for designing favorable properties of materials can be extended into the small-scale regime, however, with further reduction to the micron- and sub-micron scales, this approach may no longer be applicable. Specifically, in the last 5 years it has been ubiquitously demonstrated that fundamentally different physical mechanisms may emerge when microstructural and/or geometric dimensions of samples are reduced to the nano-meter scale. Therefore, in order to design reliable small-scale metallic components, the processing-property-microstructure relation needs to be properly adjusted to include characteristic size so that the new physical mechanisms emergent in the nano-sized structures can be captured. Further, in order to capitalize on the advantageous properties offered by nano-structuring, it is critical to develop a fundamental understanding of the effects of individual, rather than combined, nano-scale constituents on the overall mechanical properties and deformation behavior.

One of the most attractive and intriguing nano-scale microstructures is nano-twinned metals. Nano-twinned metals have been reported to attain superior strengths of ~1 GPa and deformability up to ~10% strain simultaneously, a highly desirable combination as these two properties are generally mutually exclusive for metals. Yet the deformation mechanisms responsible for such lucrative property combination are not fully understood. This is partly due to the fact that most of reported nano-twinned metals fabricated and tested to date are in bulk polycrystalline form, where randomly oriented nano-twins are embedded within the grains. As a result, experimentally-measured mechanical behavior is homogenized over the complex interactions of differently oriented grains and nano-twins, obscuring the identification of the individual roles each of these microstructural features plays on the combined high strength and ductility. In order to decipher the specific contribution of nano-twins towards extended plasticity and enhanced strengths, and thereby to utilize these principles towards synthesizing new materials with superior properties, it is imperative to develop methodologies to fabricate and test samples with well-defined isolated nano-twinned structures.

Copper has replaced aluminum as the interconnect metal of choice in microchip fabrication. An advantage of copper is its low electrical resistivity and high resistance to electro-migration and stress-migration. Lower resistance allows smaller and more tightly packed metal lines that carry the same amount of current. This leads to fewer levels of metal, faster speed, and lower production costs. Many researchers have shown that the grain boundary character plays an important role in stress-induced voiding. Voids are typically produced at the high angle grain boundaries, but not at low angle and/or twin boundaries that are found in sputtered and electroplated films, electron-beam evaporated lines and sputtered films. The damage type depended mainly on the fraction of random high angle grain boundaries, i.e. high energy grain boundaries.

The disclosure provides a method to produce arrays of free-standing vertically-aligned nano-pillars (e.g., Cu nanopillars), where each individual specimen consists of uniformly aligned nano-twins either perpendicular or inclined 1-90° perpendicular to the pillar-axis with no grain-boundaries. In one embodiment, the method inhibits stress induced voiding in the nanostructure. In-situ uniaxial tension tests were performed on individual nano-pillars with diameters of about 50 to about 100 nm in the scanning electron microscope (SEM) and analyzed the evolved microstructure in deformed pillars via transmission electron microscope (TEM) analysis. The data are corroborated by molecular dynamics (MD) simulations performed on pillars of the same diameter, twin spacing, and TB inclination angle as experimentally produced samples. Experimental results indicate that 50-nm diameter nano-pillars containing orthogonally-oriented, 1.2 nm-spaced TBs attain very high strengths of 1.35 GPa and deform via necking while those with slanted TBs deform at lower stresses of 0.95 GPa. Both samples fail via necking upon tensile loading.

A "nanopillar" refers to a structure having at least one cross sectional dimension (e.g. diameter, radius, width, thickness etc.) selected from the range of 1 nanometer to 1000 nanometers. Nanopillars in an array extend lengths that are spaced apart from each other and have features/portions that are not in physical contact with each other. In some embodiments, nanopillars in a nanopillar array do not physically contact each other. In other embodiments nanopillars in a nanopillar array contact adjacent nanopillars via base regions proximate to the internal surface of a substrate. A nanopillar typically has a structure with a length-to-width ratio of 1 to 50, e.g., about 2 to 25, and typically 3 to 15.

As used herein, the term "array" refers to an ordered arrangement of structural elements, such as an ordered arrangement of individually addressed and spatially localized nanopillars. The disclosure includes periodic arrays of nanopillars wherein nanopillars of the array are positioned at regular intervals (i.e. the distance between adjacent nanopillars measured from their centers is within 10% of the average distance between adjacent nanopillars in the array measured from their centers). In some embodiments, nanopillars in a periodic array are positioned such that the equidistant from adjacent nanopillars in the array. The disclosure also includes aperiodic arrays of nanopillars wherein nanopillar are positioned in the array at not regular intervals.

The nanopillars can be in electrical contact with one or more devices or conductive materials. "Electrical contact" refers to the configuration of two or more elements such that a charged element, such as an electron, is capable of migrating from one element to another. Accordingly, electrical contact encompasses elements that are in "physical contact." Elements are in physical contact when they are observable as touching. Electrical contact also includes elements that may not be in direct physical contact, but instead may instead have an connecting element, such as an conductive or semiconductive material or structure, located between the two or more elements.

The nano-twinned nanostructures of the disclosure have increased strength and lack defects typically found in structures existing prior to this disclosure. The lack of defects in the nanostructures of the disclosure lends the material to improved conductivity (i.e., reduced resistance) compared to non-twinned structures and shows improved mechanical strength. Such material can be used for interconnects, for example, sensors and MEMS devices.

The methods and compositions of the disclosure were tested to examine their strength and other properties. For example, both site-specific pre- and post-mortem TEM analysis and MD simulations reveal that the orthogonal-TB samples were extended via surface nucleation and extensive activity of multiple, randomly oriented dislocations, which led to their severe entanglement and multiplication. This is caused by the lack of resolved shear force along the crystallographic planes containing TBs, which therefore block dislocation glide, leading to necking.

In contrast, while the tilted-TB samples also deformed via dislocation nucleation at the TB-surface interface, the dislocations in this case glided unimpeded along the twin boundaries until their annihilation at the opposite surface. This resulted in reduced strengths, twin lamellae growth (i.e. detwinning), and no dislocation storage. This work discerns the specific role twin boundaries play on the deformation of small-scale structures and sheds further light on dislocation nucleation-governed plasticity in nano-sized volumes.

Although the focused ion beam (FIB)-based nanomachining technique is capable of successful fabrication of micro-compression and tension specimens, it has three distinct disadvantages: first, the minimum realistically attainable pillar diameter is ~150 nm, second, the degree to which ion bombardment on the surface structure translates to nanopillar mechanical performance remains a point of contention, and finally, it requires a large amount of time to manufacture individual samples, which significantly reduces the throughput. Therefore, a nano-mechanical sample fabrication methodology that does not utilize the damaging ion bombardment by using electron-beam lithography (EBL), and which is capable of producing small geometric structures (e.g., circular, columnar, conical, cylindrical, cuboidal) on the order of 100 nm or less is provided. Electron-beam lithography is a top-down lithographic fabrication technique that employs a focused beam of high-energy electrons to expose a resist (e.g., a poly(methyl methacrylate) (PMMA) resist). The interaction of the electrons within the resist solubilizes the exposed regions by severing chemical bonds and, after developing the resist in a chemical bath, the desired pattern is transferred onto the underlying seed metal film to enable further processing. Various metals can then be deposited within the open pores template by EBL via electrochemical deposition where a metal ion salt solution is potentiostatically or galvanostatically reduced at the film surface, or by alternating current/voltage techniques thus plating the desired metal. FIG. 1A shows a schematic of the fabrication procedure.

Various lithography techniques can be utilized. For example, photosensitive resists can be used to pattern a resist layer using vacuum ultraviolet light, far ultraviolet light or near ultraviolet light, or visible light, thereby patterning on a mask substrate. Photosensitivity is an attribute of a photoresist resin itself (if necessary, a light absorber or light scattering substance may be added). The resist is usually composed mainly of an organic resin, but addition of an inorganic substance is permitted.

The term "photoresist film" means a film which is usually composed mainly of an organic solvent, a base resin and a photosensitive agent and also contains another component. By an exposure light such as ultraviolet ray or electron beam, the photosensitive agent causes a photochemical reaction and a product of the photochemical reaction or this product of the photochemical reaction as a catalyst causes a large change in a dissolution rate of the base resin in a development solution, whereby patterns are formed by exposure and development subsequent thereto. When a dissolution rate of a base resin in a development solution at an exposure portion increases, such a resist is called "posi type resist", while a dissolution rate of a base resin in a development solution at an exposure portion decreases, such a resist is called "nega type resist".

The disclosure provides a FIB-less fabrication technique to create arrays of vertically oriented metal-based (e.g., metal and alloys thereof) nanostructures. The fabrication process is capable of producing a wide range of microstructures: from single crystals and twinned, to bi- and/or poly-crystalline, and nanocrystalline mechanical specimens with diameters/cross-sections from about 750 down to 25 nm with, in some embodiments, a diameter ranges below about 100 nm (e.g., about 10-100 nm). Although nanopillars are described herein as being exemplary of the techniques, other geometries comprising conical shapes, cuboidal shapes and the like are within the scope of the disclosure.

The fabrication method involves lithographic patterning of a substrate with a photoresist or with polymethylmethacrylate (PMMA) resist with electron beam lithography, followed by metal electrochemical deposition into the resist template (other methods of deposition will be apparent to one of skill in the art). Referring to FIG. 1A a general fabrication technique of the disclosure is depicted. The fabrication process begins with a rigid or semi-rigid substrate (10), upon which a conductive layer (20) is deposited using, for example, standard thin film deposition techniques (e.g., sputtering, evaporation, CVD and the like). The substrate (10) can be any rigid material such as, for example, silicon dioxide, fused-silica, quartz, silicon, organic polymers, siloxane polymers, borosilicate glass, fluorocarbon polymers, metal, hardened sapphire, and the like, or any combination thereof. The material for use as the conductive layer (20) can be any metal or conductive material of an appropriate thickness for electrochemical processing (e.g., does not form a strong passivation layer such as an oxide or which may comprise an oxide so long as the oxide is etched away before electroplating). For example, the conductive layer may be a metal, a metal-alloy, a polymer or other material (e.g., gold-titanium (Au/Ti)). The substrate (10) comprising the conductive layer (20) is then coated (e.g., by spin coating) with a polymer resist (30) that is sensitive to light or electron beam exposure. A number of such polymers are known in the art. In one embodiment, the polymer comprises polymethylmethacrylate (PMMA). The particular types of PMMA (e.g., molecular weight, dilution and solvent) are not critical and can be determined using standard skill in the art.

After spin coating and curing, the resist (30) is exposed to a light or high energy electron beam to pattern (35) the template. The exposure patterns are generated via a tool-appropriate software, allowing for precise isolation and simultaneous fabrication of indicator markers. The resolution of electron beam lithography is primarily a function of the electron dosage, whose optimal value depends on the resist type and thickness, minimum feature size, and pattern density. Since these relations are inherently nonlinear, a dose matrix was routinely used in order to empirically determine the optimal exposure conditions. After lithography (e.g., photolithorgraphy or electron beam exposure), the resist is developed to reveal the cathode surface in the exposed region.

Following the resist development, the template (40) is ready for metal deposition, which may be performed by a number of methods known in the art. In one embodiment, electrodeposition is used. In one embodiment, electrical connection is made to the metal layer underneath the resist template and a separate connection is made to a dummy cathode in order to more finely control/match the surface area match of the cathode(s) and anodes; the electrodes are then then lowered into a plating solution with an appropriate reference electrode. A large variety of metal plating solutions are available for use with this process granted the chosen electron beam resist is chemically compatible. For example, the electroplating can comprise metals such as copper, lead, tin, bismuth, indium, alloys thereof (e.g., with Cu and Au), semiconductive compounds and oxides (e.g., CdS, CdSe, CdTe, ZnS, ZnSe, ZnTe, $Bi_2Te_3$, ZnO and the like). The electroplating is then carried out either potentiostatically or galvanostatically or by alternating current/voltage techniques to fill the nanopillar resist template with a desired fill material (45). The plating time is adjusted in order to obtain the desired nanopillar height. It is important to note that there is no restriction on the number of metals which may be plated in the pores from a variety of plating solutions. For example, plating solutions and appropriate metal can include gold, silver, rhodium, copper, chrome, nickel, brass, alloys of any of the foregoing, and the like. As such various metallic heterojunctions may be fabricated within a single nanopillar. For nanopillars intended for tension samples, the plating time is chosen such that there is an appropriate level of overplated metal which may be accessed by microgrips. After metal electroplating the resist may remain in place or can be optionally stripped and the nanopillars are free for use or stress testing.

Through the use of electroplating, the final microstructure of the nanopillars can be fine-tuned over a large range of microstructures: nanocrystalline, polycrystalline, bi-crystalline, single crystalline and nanotwinned (even in the case of multi-metallic structures). This is a result of the large number of influential parameters during the plating process. These parameters include, but are not limited to (1) type and nature of the plating solution, (2) addition of organic additives; (3) applied potentiostatic or galvanostatic waveform; and (4) plating solution temperature.

In one embodiment, the electrodeposition comprises an electrolyte for Cu electroplating of 125 g/L of $Cu(SO_4)$ $5H_2O$+50 g/L $H_2SO_4$ and in the presence of a dummy chip (see, e.g., FIG. 1B). By adding the dummy chip the cross sectional area of the anode become insensitive to the small error in the area measurement, so that the current density at the anode can be reliably controlled. For example, a platinized titanium mesh is used as the anode material, and the cathode is split into two parts: the template (i.e., the patterned template) and a Cu-coated dummy chip. The purpose of the dummy chip is to precisely control the current density at the anode, which is defined as the total current divided by the cross-sectional area of the anode. With the template alone, the cross-sectional area, which is the sum of the area of the patterns on the template, is extremely small (on the order of $nm^2$ or $mm^2$) so that the current density can sharply change by a small error in the area measurement. By adding the dummy chip whose cross-sectional area is a few orders of magnitude larger than the patterns, the total cross sectional area of the anode becomes insensitive to the small error in the area measurement, so that the current density at the anode can be reliably controlled. During the electroplating, the electrolyte is mechanically stirred at the speed of, for example, 120 revolutions per minute (RPM).

To gauge the microstructure of nanopillars, transmission electron microscopy (HRTEM) and electron diffraction analysis is useful. Electroplated nanopillars are removed from the resist template and then coated by a metal, oxide, or nitride or any organo-metallic substance using any number of different deposition techniques (e.g., sputter deposition), which subsequently serves as a sacrificial masking layer. The thickness of the masking layer is maintained at about 50% to 100% of the nanopillar height. HRTEM samples are then prepared in the FIB by milling, e.g., by milling two 30 um long by 5 um wide by 5 um deep trenches above and below the pillar, leaving it on a thin lamella underneath. This lamella is then limited out of the sample and attached to a TEM grid via Omniprobe (Omniprope, Inc.) After the lamella has securely adhered to the TEM grid, the masking layer is etched away using any appropriate non-descructive etch techniques known in the art (e.g., by using an appropriate wet etch), which is selective to the metal nanostructure (e.g., nanopillar) underneath. The etching step leaves pillars ready for HRTEM imaging and free of any ion damage and redeposition.

The following examples are meant to illustrate, not limit, the disclosed invention.

EXAMPLES

The general fabrication methodology for creating nanotwinned Cu nano-pillars utilizes negative pattern transfer from a template. The template is made out of ~micron-thick e-beam resist, polymethylmethacrylate (PMMA) spin coated onto Si substrate with a thin 100 nm seed layer of evaporated Au. A pattern of circles with desired pillar diameters was written via e-beam lithography, and the resist was subsequently developed to generate arrays of through-holes to the underlying Au film (FIG. 1A). Au provides an electrically conductive path for electroplating $Cu^{2+}$ ions into these holes. The choice of Au as a seed layer stems from its inert nature in air, i.e., not forming an oxide, and insulating substrate prevents $Cu^{2+}$ ions from depositing on the backside. The composition of the electrolyte for Cu-electroplating is 125 g/L of $Cu(SO_4)$ $5H_2O$+50 g/L of $H_2SO_4$. A platinum-coated niobium mesh was used as the anode, and both the template and Cu-coated dummy chip as the cathode (FIG. 1B). The purpose of the dummy chip is to precisely control nominal current density at the cathode, defined as total current divided by the cross-sectional area of the cathode. During electroplating, the electrolyte is mechanically stirred at 120 revolutions per minute. The waveform of the applied current is periodic and rectangular (FIG. 1C). The current density, $J_{peak}$, is maintained at 0.8 $A/cm^2$ during on-time ($t_{on}$) and reduced to 0 $A/cm^2$ for off-time, $t_{off}$. The off-time is always set to 100 ms, and the $t_{on}$ controls the average thickness, $\lambda$, of twin lamellae. For example, when $t_{on}$, was 2 ms, the average $\lambda$ of 1.2 nm and 4.3 nm was attained for 50 nm and 100 nm diameter pillars, respectively.

Uniaxial tension experiments were carried out with custom-made tensile grips in the SE-Mentor, a custom-made in-situ mechanical deformation instrument where the deformation process can be observed in a SEM. The nominal strain rate was $1.0\times10^{-3}$ $sec^{-1}$ for all samples. The particular nanopillar used to conduct TEM analysis before and after deformation was attached to the TEM lift-out grid by plucking it from the substrate and subsequently gluing its bottom to the grid by using focused e-beam W deposition. During the plucking process, the nano-pillar was first guided into the SEMentor tension grips, as depicted in FIG. 3A, and detached from the substrate by gently nudging the sample stage. Once detached, the nano-pillar was lifted off the substrate in the SEMentor tension grips (FIG. 3B), and transferred on top of a post on the TEM lift-out grid (FIGS. 3C and 3D). Finally, the bottom of the nano-pillar was welded using e-beam W deposition in the FIB to make it suitable for the tension experiment. The pillar was mechanically tested in SEMentor and analyzed in TEM directly on the TEM grid, ensuring pre- and post-deformation TEM analysis on the same pillars under identical electron-beam conditions. The tension experiments for all the other pillars were performed directly on the electroplated substrate. In order to enhance the adhesion of pillars to the substrate, pillars with 100 nm diameter were also glued to the substrate using the same type of W-deposition.

Large-scale atomistic simulations were performed on nanotwinned Cu pillars under uniaxial tension. The simulated samples were 50 nm in diameter and 150 nm in height, with uniform TB spacing of 1.25 nm. These size parameters are closely matched with those in the experiments. The height of the pillar was three times the diameter, which enables to exclude the end constraints from the deformation in the middle part. The sample contained about $25.05\times10^6$ atoms. Two samples with different orientations were studied: one that has orthogonally-oriented twins, i.e., TB orientation is perpendicular to the pillar axis, while the other had slanted twins at 18° with respect to the axial direction.

At the beginning of simulations, the samples were relaxed and equilibrated at 300 K for 300 picoseconds (ps) using a Nose-Hoover thermostat and a Beredsen barostat. Then the simulated samples were stretched in the axial direction under a constant engineering strain rate of $2\times10^8$ $sec^{-1}$. This tensile loading was accomplished by the following stepwise straining method. In each loading step, an incremental tensile strain of 0.02% is applied and followed by a system relaxation for 1 ps, while three layers of atoms at both ends of the pillar were maintained fixed. Such loading process was repeated for 1750 steps, so that the final strain was 35%. Throughout the simulations, the temperature was kept constant via the Nose-Hoover thermostat. The embedded-atom-method potential was adopted to calculate interatomic forces. A multiple time step algorithm was used to speed up the computation, with the short and long time steps taken as 0.001 and 0.003 ps, respectively.

To identify the defects during deformation of the samples, atoms were painted in different colors using the local crystal order analysis: atoms with face-centered-cubic (fcc) order were colored in grey, atoms with hexagonal-close-packed (hcp) order in red, atoms in dislocation cores in green, atoms near vacancies in blue, and fully disordered atoms in yellow. Based on this classification scheme, a single red layer stands for a TB, two adjacent red layers represent an intrinsic stacking fault and two red layers separated by a grey layer indicate an extrinsic stacking fault. In addition, another coloring scheme (referred to as the position-based coloring) was used to generate 3D effects, where colors represent the distance of atoms to the centre of the simulated pillar.

Figure 2:
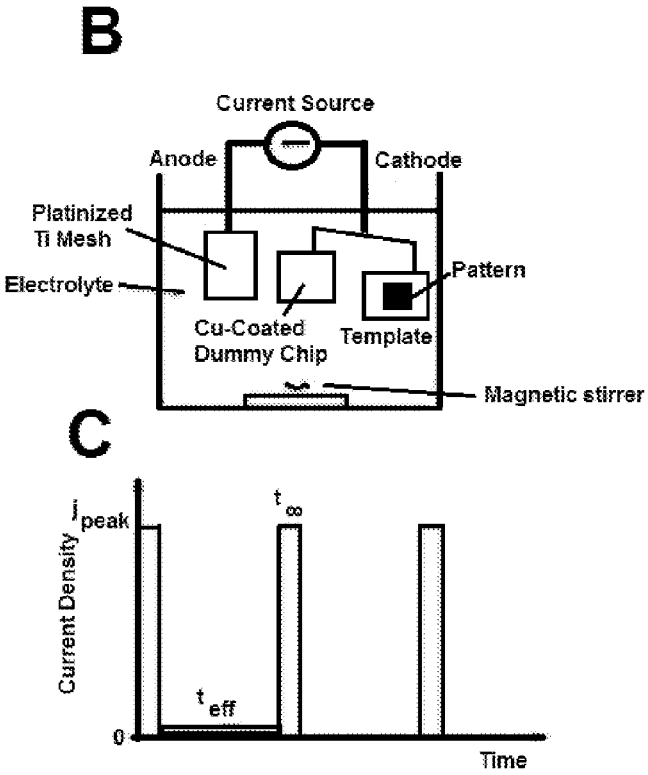
FIG. 2 shows images and schematics of a nanostructure of the disclosure. (A) SEM image of a typical as-fabricated nano-twinned Cu nano-pillar with an intentionally overplated cap for tensile testing. (B,C) Dark field TEM images and electron diffraction pattern (inset) taken from the [011] zone axis direction at different magnifications. (D) HREM image taken from [011] zone axis direction, showing several twin lamellas and twin-boundaries. (E) Fourier-filtered HREM image of the lower-left part in (D). The white solid lines indicate the atomic planes that belong to the [011] zone. (F) Schematic showing the orientation of the incident electron beam direction and some relevant crystallographic planes and direction of the nano-twinned Cu nano-pillar.
Figure 2:
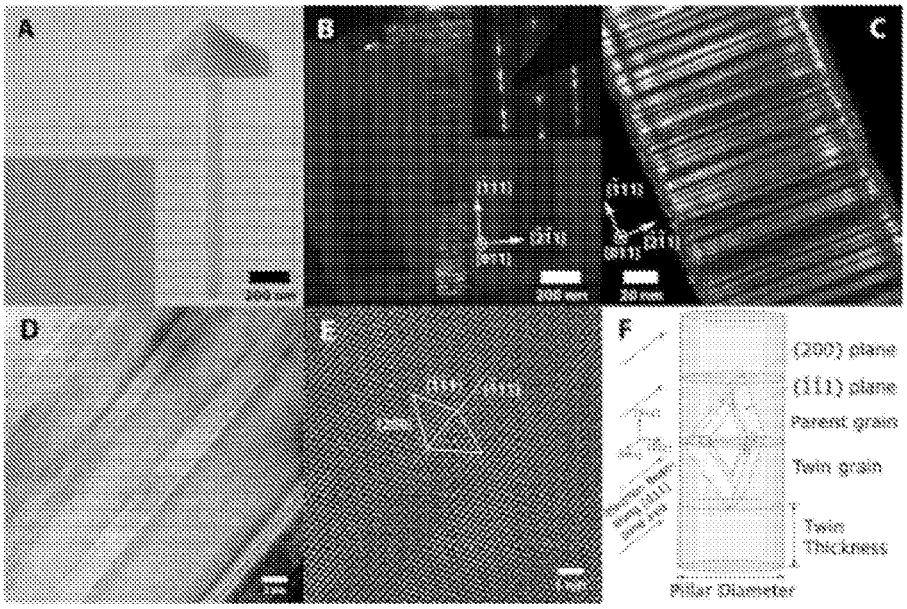

FIG. 2 shows SEM and TEM images, as well as an electron diffraction pattern of a representative electroplated nano-twinned Cu nano-pillar. FIG. 2A shows an as-fabricated sample with 50 nm diameter, which was intentionally over-plated to form a cap on top of the pillar to be used for tension experiments. Of note, the pillar section does not have any noticeable taper often associated with the widely utilized top-down focused ion beam (FIB)-based technique for nano-pillar creation. Inset in FIG. 2A is a zoomed-out SEM image of the plated template showing a nano-pillar array at 52 tilt. FIGS. 2B and 2C show the low and high magnification dark-field TEM images of 100 nm diameter nano-pillars containing orthogonal TB. Corresponding electron diffraction pattern is displayed in the inset of FIG. 2B. The incident electron beam is along [011] zone axis direction. The average twin thickness of the pillar shown in FIGS. 2B and 2C is 4.3 nm. In FIG. 2C, the ~5 nm thick outer amorphous layer is likely the native copper oxide. FIG. 3D show a high resolution transmission electron microscopy (HRTEM) images. The electron beam direction in these images is also along [011] zone axis, which is perpendicular to the TB plane normal. The solid lines in FIG. 2E are inserted to help identify (200), ($\bar{1}\bar{1}1$), and ($\bar{1}11$) planes, which belong to the same [011] zone. It can be seen that these planes are mirror-symmetric across the TB. It is also evident in FIG. 2D that the TBs are highly coherent as the lattice planes do not lose the crystallographic registry across the boundary. No initial dislocations were found after carefully analyzing approximately ~50 TEM dark-field images over the entire pillar length.

Samples with three different internal/external geometries were tested experimentally. The specific characteristic length scales for each of these samples are listed in Table I. Uniaxial tension experiments were performed at the nominal strain rate of $1.0\times10^{-3}$ $sec^{-1}$. FIG. 4 shows engineering tensile stress-strain curves for (A) D100A0, (B) D50A0, and (C) D50A18, respectively, and the insets display post-deformation SEM images (A,C) and bright-field TEM images (B). Intriguingly, 100 nm diameter pillars with perpendicular TBs appear to exhibit characteristics of brittle fracture, i.e., linear elastic loading followed by sudden failure without any noticeable plasticity. The tensile stresses at fracture range from 1.8 to 2.5 GPa, with the average of 2.1 GPa, a value on the order of ~40% of the ideal strength of copper and 1.5 times higher than the ultimate tensile strength of single-crystalline Cu nano-pillars with similar diameters. The post-mortem SEM image presented in the inset of FIG. 4A reveals no evidence of necking or shape change, suggesting that the failure is of brittle nature. This is further supported by the fact that the fracture surface in FIG. 4A is nearly perpendicular to the loading axis as opposed to being slanted at a 45° angle. In contrast, the 50 nm diameter samples (D50A0 and D50A18) with both orthogonal and slanted TBs show enhanced plasticity rather than brittle fracture shown in 100 nm diameter sample (D100A0). The engineering stress-strain curves in FIGS. 4B and C show an extended plastic regime without any appreciable work-hardening. The insets in FIGS. 4B and C show clear neck formation, further supporting the observation of localized plasticity in these nano-pillars. The average tensile strengths of the 50 nm diameter nano-pillars was shown to be 1.35 GPa for orthogonal TBs (D50A0) and 0.95 GPa for slanted (D50A18) TBs. This ~30% difference in yield strength is likely due to the distinct dislocation behavior in these samples. In the former the twin boundary planes do not experience any resolved shear stress and, therefore, there is no driving force for dislocation glide along the boundaries, as is the case in the tilted-boundaries sample. In addition, reported molecular dynamics simulations reveal that the inclination angle of twin boundaries greatly affects the contribution of image stress on dislocation nucleation.

Table 1:

TABLE I

List of experimentally tested samples.

| Sample Name† | Diameter (D) | Twin Spacing (λ) | TB angle |
|---|---|---|---|
| D50A0 | 50 nm | 1.2 nm | orthogonal |
| D50A18 | 50 nm | 1.2 nm | inclined by 18° |
| D100A0 | 100 nm | 4.3 nm | orthogonal |

†D and A in the sample names stand for diameter and angle, respectively

While the image force produced by TBs generates a repulsive stress field for dislocation activities inside the pillar at TB-surface intersection for samples with orthogonal TBs, its influence to those with slanted TBs is nearly negligible. As a result, orthogonal samples require additional applied stress to overcome the repulsive image stress imposed by the TBs while this is not the case for the slanted samples. This effect of the TB inclination angle is discussed in more detail elsewhere herein in conjunction with the atomistic simulation results. It should be noted that the slope of the elastic regime in FIG. 4 of ~60 GPa is significantly lower than Young's modulus of Cu along [111] direction, 191 GPa. This discrepancy is likely due to a slight misalignment between pillar and loading axes during the experiment. For example, it has been shown that a mere 2° of misalignment can lead to a reduction in the measured Young's modulus by a factor of 3 in uniaxial compression.

In addition, the wavy signature near the origin of stress-strain curves in FIGS. 4B and C is because of instrumental artifacts, which occurred when the tension grip made contacts with samples. This does not appear to carry any effect into the mechanical behavior thereafter.

FIG. 5 presents the TEM analysis of the deformation-induced microstructural changes for nano-pillars with 50 nm diameters. To conduct this rigorous analysis, it was necessary to tilt the sample such that the direction where [110] zone axis contained within the TB plane was aligned with the incident electron beam. FIGS. 5A and C schematically illustrate this orientation, where the circle (A) or ellipse (C) indicate the TB planes and the arrows within them point at the [110] zone axis direction. Interestingly, while D50A0 and D50A18 differ only by TB inclination angle with all the other dimensions same, they exhibit drastically different microstructural evolution. When TBs are perpendicular to the loading axis (D50A0), the deformation is highly localized in the neck periphery, with all other region remaining virtually unaffected. The dark-field TEM image on the left in FIG. 5B displays this behavior, where necking is highlighted by the square box. The dark-field image in the top right corner of this figure shows evidence of intense dislocation activity. Here, multiple parallel dark lines (indicated by arrows in FIG. 5B) were evidently formed across the twin lamellae, suggesting that they are traces of dislocations, which were likely nucleated at TB-surface intersections and subsequently glided in several different slip planes, leading to entanglement and multiplication. Interestingly, the thickness of the twin lamellae in the heavily deformed region appears to be unchanged since it is comparable with that in the un-deformed lower part of the pillar, where no evidence of deformation can be found. In stark contrast to this deformation behavior, pillars with slanted TBs (D50A18) exhibit clear growth of twin lamellae thickness, also known as de-twinning, after plastic deformation. In FIG. 5D, it can be clearly seen that the twin lamella thickness increased up to ~15 nm after deformation (left image) as compared with the pre-deformation image (inset). Moreover, the surface of each twin lamella became faceted as can be seen in FIG. 5D, further suggesting that each lamella was actually deformed by shear and that de-twinning was the result of deformation. It was thus hypothesize that de-twinning occurred by sequential nucleation of Shockley partial dislocations at TB-surface intersections and their subsequent relatively unimpeded glide along the TB planes. Atomistic simulations discussed elsewhere herein corroborate both of these deformation mechanisms.

To investigate plasticity mechanisms in sub-100 nm nanotwinned Cu pillars, molecular dynamics (MD) simulations of equivalent diameter pillars were carried out under uniaxial tension, with the largest diameters of simulated samples of 50 nm. Such large-scale simulations complement the experiments by providing the fundamental microstructural deformation mechanisms in the nano-twinned pillars.

Atomic configurations along the middle longitudinal section of the deformed sample with orthogonal and slanted TBs are illustrated in FIG. 6A-C and D-G, respectively. FIG. 6A shows that in the orthogonal-TB samples, where TB planes do not experience any resolved shear force, a large number of dislocations is nucleated at the TB-surface intersections or near the fixed ends, and then glide on slip planes inclined to the TBs. When these dislocations arrive at the TBs, three types of dislocation reactions were observed: (1) full trapping of dislocations by a TB, (2) cross-slip through a TB, and (3) dissociation followed by one dislocation transmitted through a TB and another residual on a TB. As a result of these reactions, TBs are decorated by many dislocations, some of which are mobile Shockley partials capable of slipping on the TBs in the presence of a resolved shear stress. The dislocation-TB interactions lead to the formation of neck and resultant shear bands which gradually broaden as the applied strain increases, as shown in FIGS. 6B and C as well as in the experimental results in FIGS. 4 and 5. During the growth of shear bands, some of the original TBs are completely destroyed, as indicated by the arrows in FIG. 6B. The shear bands can be identified in yet another manner (FIG. 6C). In the initial sample, atoms in different twin lamella (a total amount of 143) were assigned using different colors. All the twin lamella are initially orthogonal to the loading direction. Once a shear band arises due to dislocation penetration through TBs, the twin lamella will be locally dislocated. In the regions surrounded by the black lines in FIG. 6C, the twin lamella are severely distorted along the shear direction, indicating that those regions are indeed the well-developed shear bands. In addition, it is noted that a void is nucleated near the right end from stress-driven aggregation of vacancies. During plastic deformation, this void does not seem to grow. The shear band is a manifestation of shear strain localization, which is a common deformation mode in ductile materials. Such deformation mode has been reported in experimental studies on nano-twinned Cu—Al alloy processed by dynamics plastic deformation as well as atomistic simulations of nano-twinned Cu under uniaxial tension. FIG. 6D-G show the atomic structures of half of the pillars with tilted TBs (inclination angle of 18°) extended to different strains. Here, it can be seen that massive dislocation slip on TBs leads to TB migration and even disappearance of some twin lamellae. This de-twinning exactly coincides with the experimental results shown in FIG. 5D. Such phenomenon has also been observed in large-scale MD simulations for uniaxial tension of nano-twinned wires with tilted TBs (inclination angle of 30°). The depletion of twins leads to the formation of multiple surface steps because of dislocations escaping from the free surface.

Subsequently, these surface steps serve as sources of new dislocation for further plastic deformation. After the middle part of the sample becomes twin-free, dislocations glide on other, non-twin, slip planes. As shown in FIG. 6E, numerous dislocations are nucleated from the surface steps and travel through the interior, leading to the dislocation tangle shown in FIG. 6G. Compared to the entangled dislocation structure in FIG. 6G, FIG. 6F shows more ordered dislocation lines gliding on TBs during the de-twinning process.

FIG. 7A shows the stress-strain curves obtained by MD simulations for uniaxial tension of nano-twinned pillars with orthogonal and tilted TBs. Since all samples were initially dislocation free, the peak stress shown in FIG. 7 should largely reflect the stress required for either full or partial dislocation nucleation. The samples with orthogonal TBs generally have higher stresses, especially the peak stress, than those with tilted ones, and these stress-strain curves are comparable with our experimental data (FIG. 4). This implies that dislocation nucleation and propagation in the samples with orthogonal TBs are harder to activate or maintain than those in the samples with tilted TBs. The subsequent drop in the stress is caused by dislocation propagation immediately after nucleation. Once enough mobile dislocations have been generated to accommodate the imposed deformation, the stress drops down to a lower level, and dislocation density rises up to a higher level. As the deformation proceeds, new dislocations continue to nucleate and/or multiply while the existing mobile dislocations tend to annihilate due to dislocation reactions or escape from the free surface. The dislocation density saturates as the annihilation rate is balanced by the nucleation rate. Such evolution of dislocation density corresponds to the black curve in FIG. 7B for the sample with orthogonal TBs. For the sample with tilted TBs, on the other hand, dislocation density rises only slightly after the initial yielding, as dislocation slip is activated again after de-twinning. FIG. 7C shows a reduction in the number of hexagonal-close-packed (hcp) atoms in the course of deformation, providing strong evidence for the de-twinning process. In nano-twined metals, de-twinning involves successive TB migration via partial dislocation slip along pre-existing TBs. Such processes eventually lead to vanishing of the twins and reduction in hcp atoms. For the sample with tilted TBs, the detwinning process lasts from 7% to 24.5% strain. Contrary to this mechanisms, in the sample with orthogonal TBs, the reduction in hcp atoms is mainly caused by TBs being destroyed by dislocation-TB interactions, which results in loss of their coherency. Here de-twinning plays only a minor role (if at all) in the decreasing of number of hcp atoms.

Although a number of embodiments and features have been described above, it will be understood by those skilled in the art that modifications and variations of the described embodiments and features may be made without departing from the teachings of the disclosure or the scope of the invention as defined by the appended claims.

What is claimed is:

1. A method of making a nano-twinned nanopillar composition comprising:

(a) coating a substrate with a conductive layer;

(b) coating the conductive layer with a resist polymer;

(c) using a lithography technique to pattern a template into the resist polymer, wherein the template serves as a template-cathode;

(d) providing an anode;

(e) providing a non-patterned cathode wherein the total surface area of the template-cathode and non-patterned cathode is substantially equal to the surface area of the anode;

(f) electrodepositing a metal into the template; and (g) optionally removing the resist.

2. The method of claim 1, wherein the substrate comprises a material selected from the group consisting of silicon dioxide, fused-silica, quartz, silicon, organic polymers, siloxane polymers, borosilicate glass, fluorocarbon polymers, metal, hardened sapphire and a ceramic.

3. The method of claim 2, wherein the substrate is silicon.

4. The method of claim 1, wherein the conductive layer comprises a conductive metal.

5. The method of claim 1, wherein the resist polymer comprises polymethyl methacrylate.

6. The method of claim 1, wherein the electrodepositing is by potentiostatic, galvanostatic or by alternating current/voltage techniques.

7. The method of claim 1, wherein the metal is selected from the group consisting of gold, silver, rhodium, copper, chrome, nickel, brass, iridium and alloys of any combination of the foregoing.

8. The method of claim 1, further comprising coating with a metal oxide, nitride or other organo-metallic material.

* * * * *